United States Patent [19]

Jinkins

[11] 4,306,330

[45] Dec. 22, 1981

[54] AIR-POWERED VACUUM CLEANER FLOOR TOOL

[75] Inventor: Danny R. Jinkins, Bel Air, Md.

[73] Assignee: Black & Decker Inc., Newark, Del.

[21] Appl. No.: 72,231

[22] Filed: Sep. 4, 1979

[51] Int. Cl.[3] ..... A47L 5/10

[52] U.S. Cl. ..... 15/325; 15/377; 15/387; 15/392

[58] Field of Search ..... 15/325, 377, 387, 389, 15/392, 183

[56] References Cited

U.S. PATENT DOCUMENTS

| | | | |
|---|---|---|---|
| 2,101,575 | 12/1937 | Dow . | |
| 2,314,081 | 3/1943 | Dow et al. | 15/387 |
| 2,659,098 | 11/1953 | Meyerhoefer | 15/325 X |
| 2,683,276 | 7/1954 | Olsen | 15/387 |
| 2,734,220 | 2/1956 | Tschudy | 15/410 |
| 2,962,748 | 12/1960 | Magarian | 15/387 |
| 2,963,270 | 12/1960 | Magarian | 253/40 |
| 3,005,224 | 10/1961 | Magarian | 15/392 X |
| 3,071,799 | 1/1963 | Jepson et al. | 15/354 |
| 3,120,021 | 2/1964 | Pauler et al. | 15/377 |
| 3,225,374 | 12/1965 | Daley et al. | 15/183 |
| 3,354,496 | 11/1967 | Jonsson | 15/377 |
| 3,815,170 | 6/1974 | Brooks et al. | 15/377 X |
| 4,167,801 | 9/1979 | Erbor et al. | 15/377 |

FOREIGN PATENT DOCUMENTS

| | | | |
|---|---|---|---|
| 223232 | 8/1959 | Australia | 15/387 |

*Primary Examiner*—Chris K. Moore

*Attorney, Agent, or Firm*—Harold Weinstein; Leonard Bloom; Edward D. Murphy

[57] ABSTRACT

A vacuum cleaner floor tool is provided which comprises a housing, an air-powered turbine motor in the housing and an agitator partially extending from the housing. The agitator has spiral grooves therein which hold agitating devices, such as brushes or beater bars, and one end of the agitator is reduced or turned down to form a reduced diameter portion. The diameter of the reduced diameter portion is such that the spiral grooves form substantially flat surfaces and these surfaces are engaged by lugs on a connector fitted over the reduced portion. A transmission belt interconnects the connector with the turbine motor in order to drive the agitator. The floor tool has a removable base plate mounted on the housing which forms one wall thereof, and the agitator extends from the housing through an opening in the base plate. A manually operable base plate retaining device is mounted on the housing to hold the base plate in place during operation, with the retaining member being easily operable to allow for removal of the base plate. A bumper strip is mounted on the housing and surrounds the housing. The bumper strip includes a lip which extends therefrom and engages the base plate in order to form an air seal therewith.

7 Claims, 26 Drawing Figures

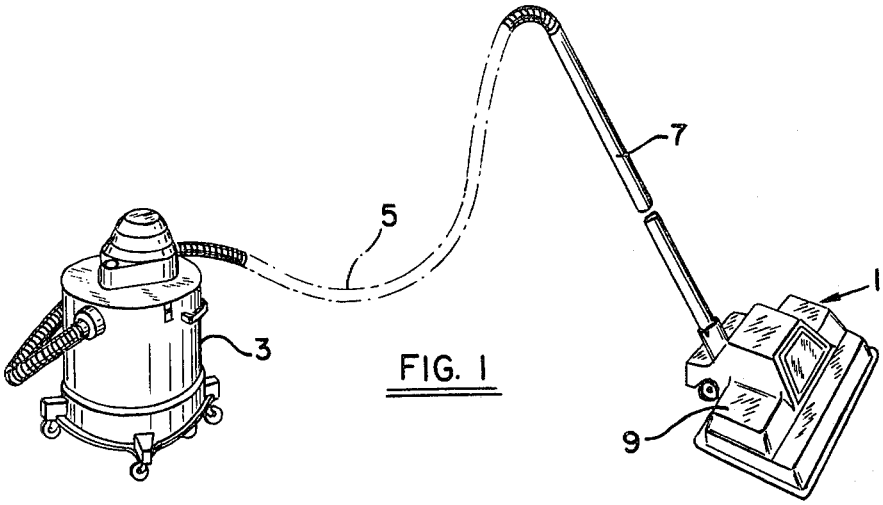
FIG. 1
FIG. 2
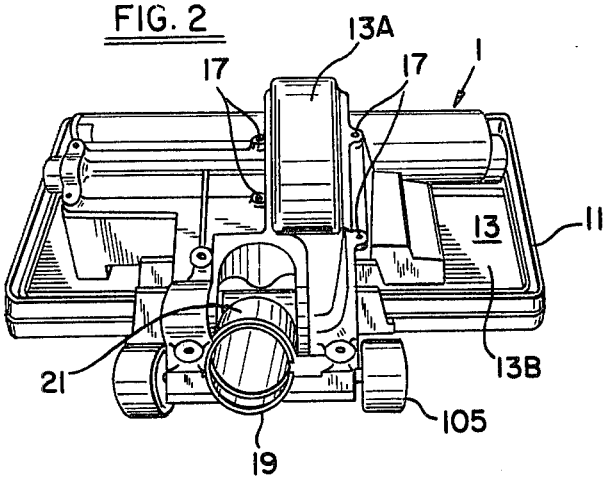
FIG. 3
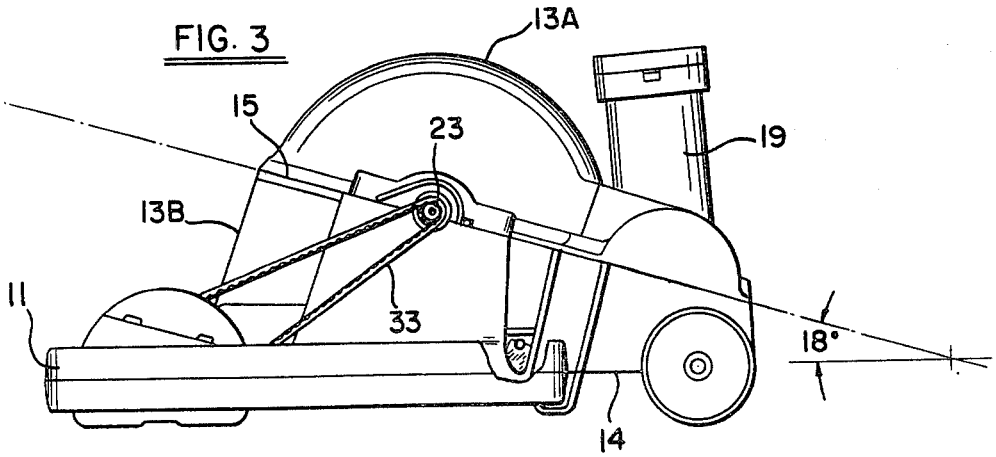

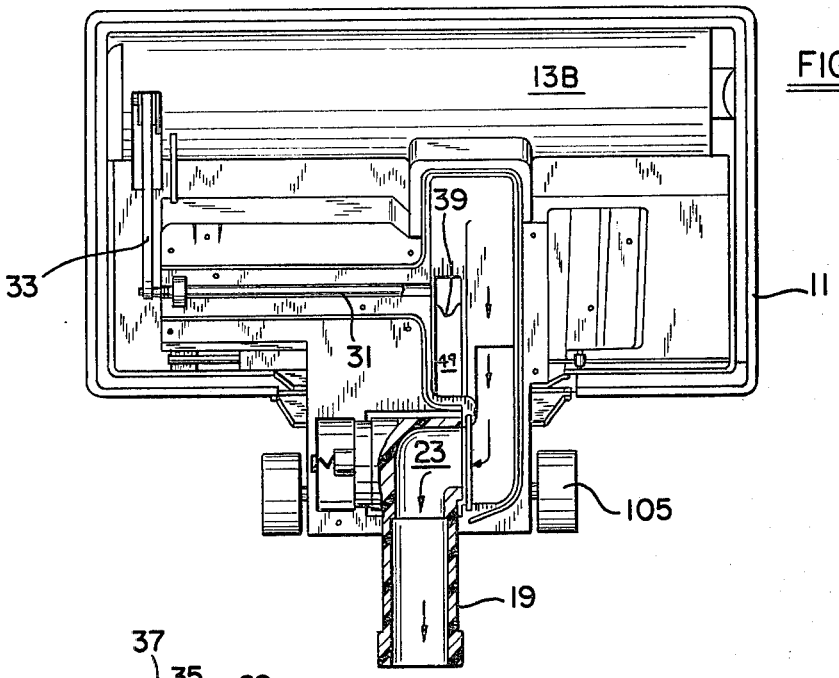
FIG. 4B
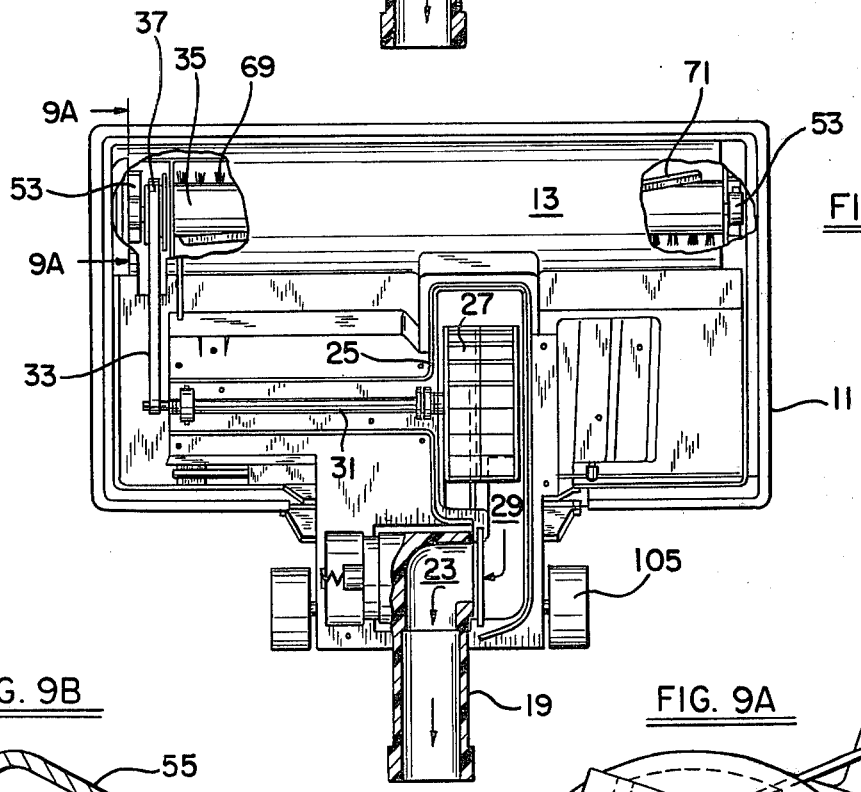
FIG. 4A
FIG. 9B
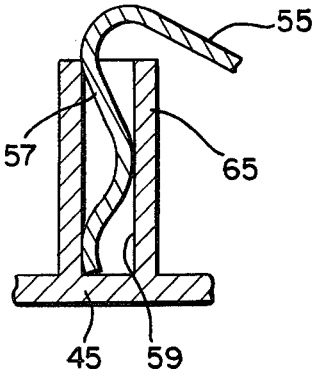
FIG. 9A
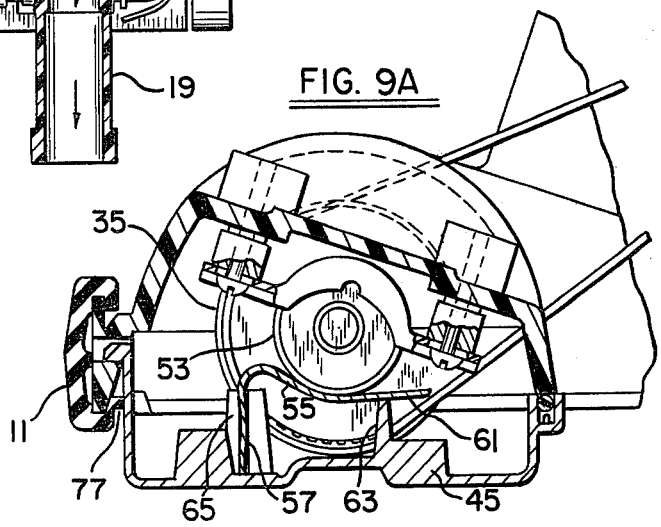

AIR-POWERED VACUUM CLEANER FLOOR TOOL

BACKGROUND OF THE INVENTION

1. Field of the Invention

This invention is related to a vacuum cleaner floor tool and, more particularly, to a vacuum cleaner floor tool having a turbine motor driven agitator wherein the floor tool has a manually operated retaining device for holding the floor tool base plate in place during operation, a bumper strip having a lip which contacts the base plate and forms an air seal therewith, and simply formed surfaces on the agitator for mating with a connector of the agitator drive mechanism.

2. Description of the Prior Art

Vacuum cleaner floor tools having air-powered turbine motors for driving agitators are known in the prior art. Typical examples of these can be found among the following U.S. Pat. Nos. 2,683,276; 2,962,748; 2,963,270; 3,005,224; 3,071,799; 3,354,496.

All of these patents, however, suffer from various disadvantages. In Magarian U.S. Pat. No. 3,005,224, for example, the ramp which forms the nozzle to the air-powered turbine motor is a separate element from the base plate and, therefore, suffers from problems of alignment, difficult removal, etc. Furthermore, these patents do not disclose manually removable base plates to provide access to the interior of the turbine motor. Typically, these patents have screw-mounted base plates which require the use of a screwdriver for their removal and, in some instances, such as Magarian '224 noted above, have a small access hole in the base plate. The small access hole is not, however, adequate for the removal of many of the objects which may become lodged in the nozzle or turbine motor. Because of the small size of the hole, access is very limited.

Split clam-shell type housings have also been used in vacuum cleaner floor tools as, for example, in some of the patents cited above. However, these housings are not split along a single plane which is inclined with respect to the base or bottom of the lower housing member. The split housings of the prior art wherein the split is formed along more than one plane present difficulties in sealing the two housing members together, which is necessary in order to prevent leakage through the mating surfaces. In order to provide adequate sealing in the prior art, it is necessary that the pieces be formed with close tolerances and structurally complicated sealing means must be provided.

Elbow-type couplings for vacuum cleaner wands and hoses are also known in the prior art vacuum cleaner floor tools as, for example, those shown in the following U.S. Pat. Nos. 2,101,575; 2,314,081; 2,734,220; 3,701,799.

Some of the above patents disclose latching mechanisms which allow the extension portion of the elbow which connects to a vacuum cleaner wand to be placed in a fixed position, such as a vertical storage position, and in a rotatable position, such as that during the use of the vacuum cleaner. The latch mechanisms are, however, complicated, requiring a foot pedal, various nuts and bolts and structurally complicated parts.

The agitators in prior art vacuum cleaner floor tools are driven by either air-powered or electric motors within the floor tools. These agitators are coupled to the motors by various types of drive belts. Generally, a pulley connector is connected to the agitator by means of a press or friction fit, or by a special flat surface formed on the agitator. These structures require either separate manufacturing steps or, as in the specilly formed surfaces, are subject to wear and slippage such as in the press or friction fitted connectors.

SUMMARY OF THE INVENTION

It is an object of the present invention to provide a vacuum cleaner floor tool which has a manually operated retaining device for holding the base plate on the housing. The retaining device holds the base plate in place during operation, but is manually operable so that an operator may unlock or release the base plate and then remove it to gain access to the nozzle or turbine motor to remove an object therefrom. The manually operable aspect of the retaining device eliminates the requirement for a tool, such as a screwdriver, for releasing the base plate.

It is another object of the present invention to provide a vacuum cleaner floor tool which has a bumper strip surrounding the floor tool where the bumper strip includes a lip which extends from the strip and contacts the base plate to form an air seal with the housing. This eliminates air losses resulting from leakage of air drawn from above the base plate.

It is a further object of the present invention to provide a vacuum cleaner floor tool in which a rotary agitator is coupled to, and driven by, the turbine motor. The connector is fitted onto a portion of the agitator which is formed using existing agitator structure.

The present invention is directed to a vacuum cleaner floor tool which comprises a housing, an air-powered turbine motor in the housing and an agitator partially extending from the housing. The agitator has spiral grooves therein which hold agitating devices such as brushes or beater bars, and one end of the agitator is reduced or turned down to form a reduced diameter portion. The diameter of the reduced diameter portion is such that the spiral grooves form substantially flat surfaces and these surfaces are engaged by lugs on a connector fitted over the reduced portion. A transmission drive belt interconnects the connector with the turbine motor in order to drive the agitator. The floor tool has a removable base plate mounted on the housing which forms one wall thereof, and the agitator extends from the housing through an opening in the base plate. A manually operable base plate retaining device is mounted on the housing to hold the base plate in place during operation, with the retaining member being easily operable to allow for the removal of the base plate. A bumper strip is mounted on the housing and surrounds the housing. The bumper strip includes a lip which extends therefrom and engages the base plate in order to form an air seal therewith.

One of the features of the present invention is the manually operable base plate retaining device or latch which securely holds the base plate in position during operation, but which is simple to operate and does not require tools to enable the user to unlatch and remove the base plate in order to gain access to the interior of the nozzle and turbine motor to remove objects therefrom. The base plate retaining device is easy to operate, requires no tools, has a minimum number of parts, exerts a large holding force on the base plate and has a wide range of tolerances. The device can be operated with one hand and is independent of the base plate and can be moved out of the way in order to provide access to the interior of the housing. Furthermore, the base plate is inclined at the point of contact in order to concentrate force of the retaining device in the center of the base plate.

Another feature of the present invention is the provision of a bumper strip which surrounds the housing, the bumper strip having a lip contacting the base plate to form an air seal. Since the air seal is formed by a lip on the bumper strip itself, this lip can be formed during manufacture of the bumper strip. Thus, it is easy to manufacture and can be produced at substantially no additional cost.

Still another feature of the present invention is the coupling used to couple the rotary agitator to the turbine motor. The rotary agitator has spiral grooves which have agitating devices, such as brushes or beater bars, mounted therein. The diameter of one of the ends of the rotary agitator is reduced down so that a reduced diameter is formed such that the bottom of the spiral grooves form substantially flat surfaces on the reduced diameter. A connector is fitted over the reduced diameter portion, and the connector has lugs which engage the flat surfaces, thereby preventing relative rotation between the connector and the rotary agitator. The connector is connected to the turbine motor by means of a belt. Since the flat surfaces are formed from spiral grooves which are already in the agitator, the coupling is simple and inexpensive. Also, since the flat surfaces are formed on a relatively large diameter, this coupling provides a good mechanical advantage.

BRIEF DESCRIPTION OF THE DRAWINGS

FIG. 1 is a perspective view of a vacuum cleaner connected to a floor tool of the present invention;

FIG. 2 is a perspective view of a floor tool of the preferred embodiment of the present invention with the cover removed;

FIG. 3 is an elevational view of the preferred embodiment of the present invention;

FIGS. 4A and 4B are top views of the preferred embodiment of the present invention, with the upper housing member removed;

FIG. 9A is an elevational view of an agitator support structure of the preferred embodiment of the present invention;

FIG. 9B is an enlarged partial section of FIG. 9A;

DETAILED DESCRIPTION OF THE PREFERRED EMBODIMENTS

Figure 6:
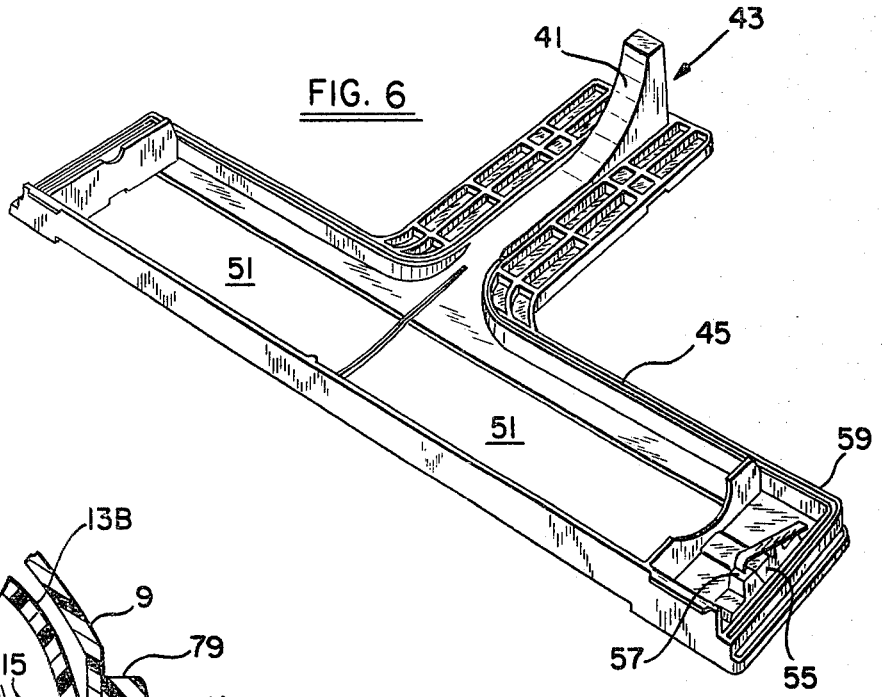
FIG. 6 is a perspective view of a base plate of the preferred embodiment of the present invention.

FIG. 1 illustrates a floor tool 1 of the present invention which is connected to a vacuum cleaner 3 by means of a hose 5 and a wand 7. The floor tool 1 of the present invention can be used with any type of vacuum cleaner, and the cannister-type cleaner 3 illustrated in FIG. 1 is merely by way of example. The floor tool 1 has a cover 9 which covers the upper portion thereof.

FIGS. 2 and 3 illustrate the floor tool with the cover 9 removed therefrom. A bumper strip 11 surrounds the housing 13 which has an upper member **13*a* and a lower member 13*b*. The members 13*a* and 13*b* mate with one another along a planar surface 15, the upper and lower members being held together by means of bolts or screws fitted into the holes 17**. This type of construction, wherein the housing is formed of an upper and a lower member, is referred to as a "clam shell" type of housing.

The surface 15 is inclined with respect to the plane of the base, or bottom 14 of the lower member **13*b*. The angle of inclination is preferably 18°. The angle of inclination of the surface 15 is significant because it permits the extension portion 19 of an elbow 21 to enter the housing 13 at a point below the axis 23 of a turbine motor which is within the housing, while simultaneously allowing the surface 15 to pass through the axis of the turbine motor. By positioning the axis of the elbow 21 on the surface 15 and below the axis 23, the operation of the floor tool is facilitated because, when an operator pushes the floor tool using the wand 7, the force is applied to a lower portion of the housing, thereby preventing a tipping of the housing over its forward end. Furthermore, since the axis 23 of the turbine motor must lie in the plane of surface 15, the inclination raises the height of the axis 23, thereby permitting the use of a larger size turbine which will, of course, result in greater motor torque and thereby enhance the efficiency of the vacuum cleaner floor tool. Also, since both axes, i.e, the axis of the coupling elbow 21 and the turbine motor axis 23**, lie in the same plane, which is the plane between the upper and lower members of the housing, the present invention eliminates the necessity for a stepped surface between the upper and lower members of the housing which would create sealing and tolerance problems.

FIG. 4A shows the floor tool of the present invention with the upper member of the housing 13A removed. The turbine motor 25 includes a rotor 27 which is positioned in a turbine chamber 29 formed by the upper and lower housing members **13*a* and 13*b*. Shaft 31, which lies on axis 23 of the turbine rotor, rotates with the turbine rotor and a drive belt 33 couples the shaft to a rotary agitator 35 through a pulley or connector 37**.

Referring to FIGS. 4–8, the nozzle of the air-powered turbine motor 25 is formed by the walls 39 of the housing member **13*b* and the face 41 of ramp 43, which is integrally formed on base plate 45. The base plate 45 is removably positioned on the bottom of lower housing 13*b* and, in FIG. 7, the dashed lines illustrate the base plate 45 in its partially withdrawn position and the solid lines illustrate it in its normally closed position. The nozzle for the turbine motor is shown at 47. Referring to FIG. 4B, which corresponds to FIG. 4A with the turbine rotor removed, the ramp 43 extends into the opening 49 in the housing member 13*b* to form the nozzle 47, along with the face 41 of the ramp 43. The base plate 45** has a large opening 51 with the rotary brush agitator 35 partially extended through the opening 51. In operation, the air for the turbine motor 25 is drawn through the opening 51 and through the nozzle 47 formed by the ramp 41 and the walls 39 of the housing 13*b* into the turbine motor 25. A pressure differential is created across the turbine motor by coupling the elbow extension 19 to a vacuum cleaner, as illustrated in FIG. 1. The rotation of the turbine rotor 25 is transmitted to the rotary agitator 35 by means of shaft 31, drive pulley or belt 33 and connector 37 to rotate the brush which agitates carpeting, for example, to enhance the removal of dirt therefrom by means of the vacuum cleaner.

Referring to FIGS. 4A, 5A and 10–12 the agitator 35 has therein a plurality of spiral grooves 67 which have therein either brushes 69 or beater bars 71. The brushes 69 or beater bars 71 agitate the carpeting to loosen dirt therein as the rotary agitator is rotated by the turbine motor. The end portion 73 of the rotary agitator 35 is reduced or turned down to a diameter in which the spiral grooves 67 are substantially flat surfaces 67*a*. The connector 37 is mounted on the reduced diameter end portion 73 of the rotary agitator 35. The connector 37 has lugs (not shown) which mate with the flat surfaces 67*a*, thereby preventing relative rotation between the connector 37 and the rotary agitator 35. The drive belt 33 drives the connector 37 which, in turn, drives the rotary agitator 35. The lugs and flat surfaces 67*a* cooperate to prevent slippage.

Figure 5B:
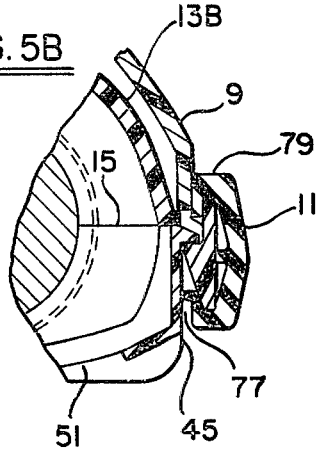
FIG. 5B is an enlarged partial section of FIG. 5A.
Figure 5A:
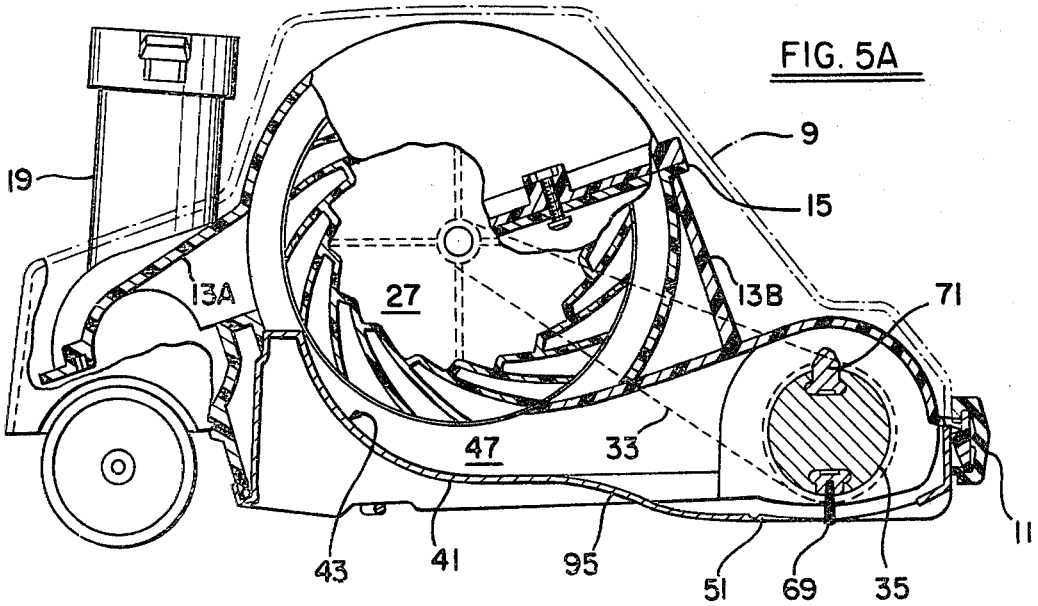
FIG. 5A is an elevational view of the invention, partially in section.
Figure 7:
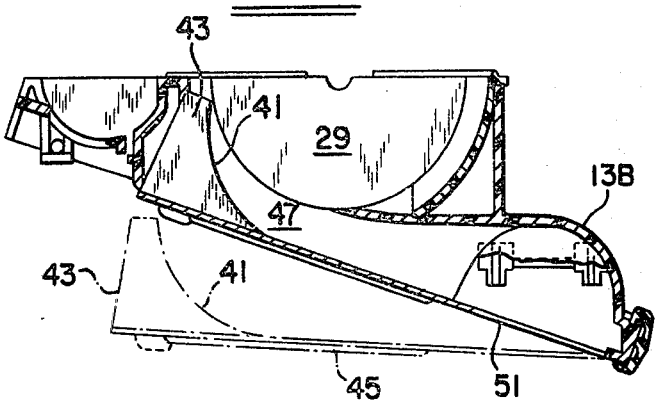
FIG. 7 is a sectional view of the base plate of the preferred embodiment of the present invention, mounted on the floor tool housing.
Figure 8:
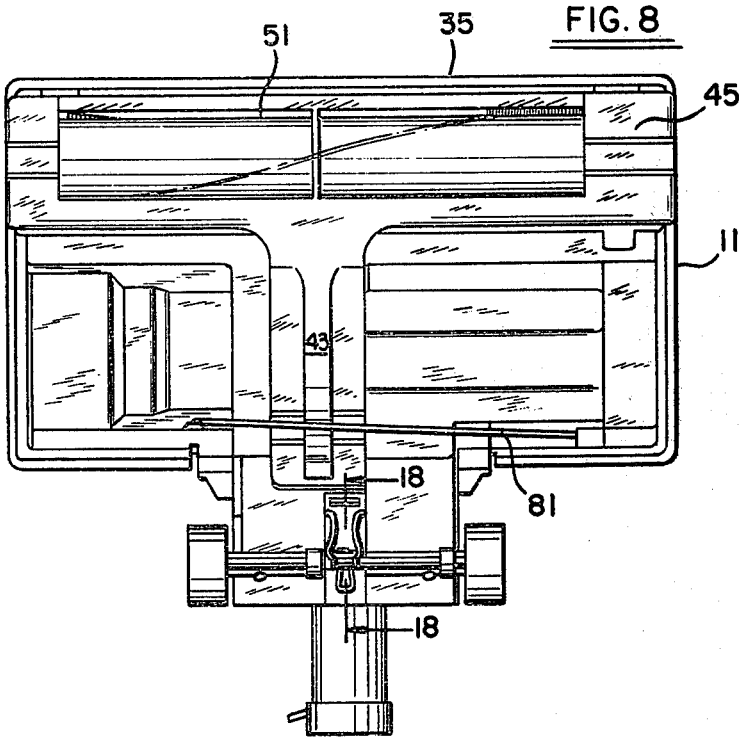
FIG. 8 is a bottom view of a vacuum cleaner floor tool of the preferred embodiment of the present invention.
Figure 10:
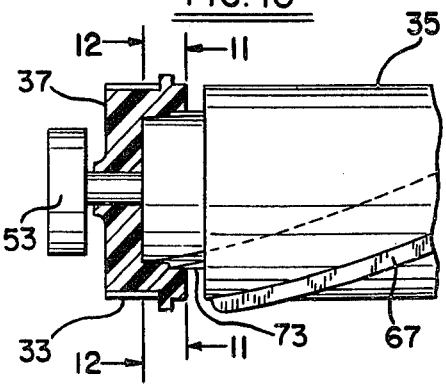
FIGS. 10–12 illustrate the preferred embodiment of the agitator drive coupling of the present invention.
Figure 11:
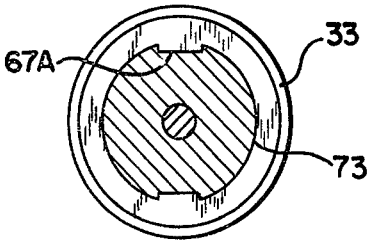
Figure 12:
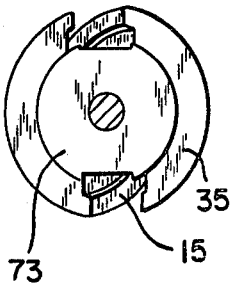

Referring to FIGS. 5A, 5B and 6, air is drawn into the housing 13 through the opening 51 in the base plate 45. In order to optimize the cleaning efficiency of the vacuum cleaner floor tool, all of the air should be drawn through the opening 51. In order to eliminate passage of air through the surface between the lower housing member 13*b* and the base plate 45, the bumper strip 11 has a small lip or extension 77 which forms an air seal with the base plate 45. This lip is integrally formed as part of the bumper strip. The top portion 79 of the bumper strip 11 forms a seal with the housing cover 9 which acts to prevent dislodging of the bumper along its perimeter.

Figure 13A:
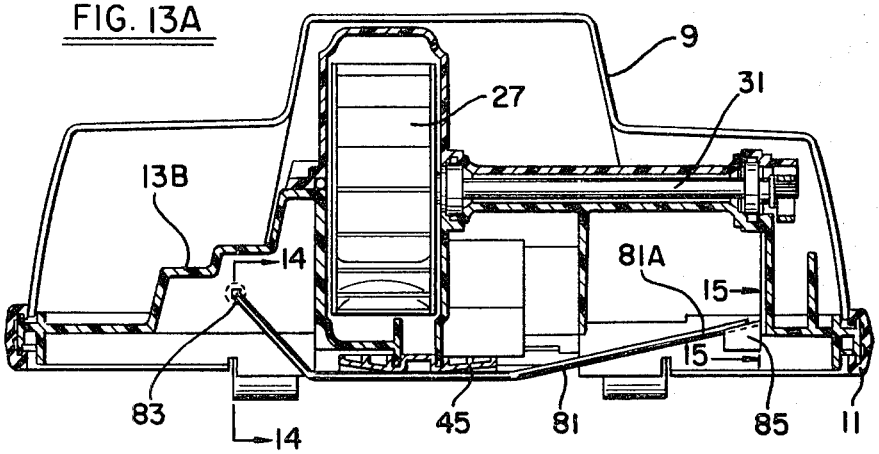
FIGS. 13A, 13B, 14 and 15 illustrate the preferred embodiment of the base plate retaining device of the present invention.
Figure 13B:
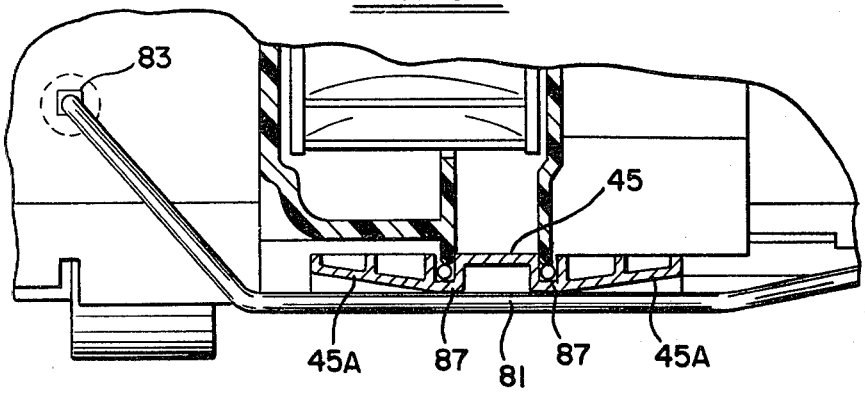
Figure 14:
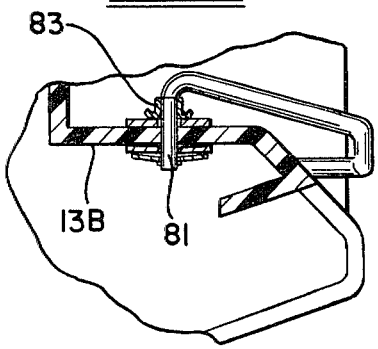
Figure 15:
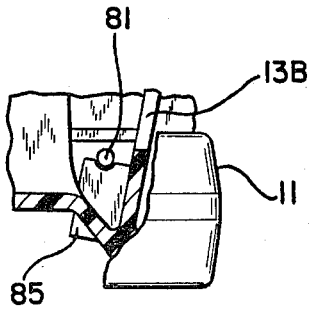

Referring to FIGS. 13–15, the removable base plate 45 is held in place by a retaining rod 81. The rod 81 is pivotally mounted in the lower housing member 13*b* at 83. The other end 81*a* of the retaining rod 81 engages a projection 85 which may be integrally formed in the lower housing member 13*b*. The base plate 45 has inclined portions 45*a* so that the retaining rod 81 engages and holds the base plate at points 87 near the longitudinal center of the base plate. This provides an even distribution of force by the retaining rod to hold the base plate in place.

When it is desired to remove the base plate 45 in order to remove an object which may have become lodged in the turbine chamber, the end 81*a* of the retaining rod 81 is manually lifted from the projection 85 and pivoted about point 83. This results in the disengagement of the retaining rod 81 from the base plate 45, and the positioning of the rod 81 in a non-obstructing position. The base plate 45 may then be lifted out of the housing 13, thereby exposing the interior of the turbine chamber.

Referring to FIGS. 6 and 9, the ends of the rotary agitator 35 have bearings 53 which are supported by springs 55. The springs 55 have ends 57 which are inserted into slots 59 formed in a boss 65 of the base plate 45, while the other ends 61 are supported on studs 63 formed on the base plate 45. The springs 55 are held in slots 59 by means of the bent end portions 57.

Figure 16:
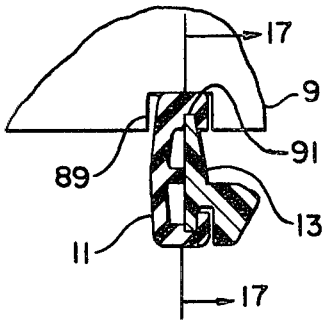
FIGS. 16 and 17 illustrate the preferred embodiment of the bumper strip retaining structure of the present invention.
Figure 17:
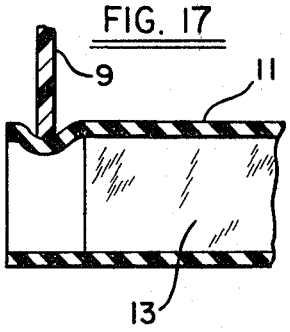

Referring to FIGS. 16 and 17, the bumper strip 11 is held in place by means of a notch 89 in the rear portion of the cover 9. When the cover is placed over the housing 13, the notch engages the upper portion of the bumper strip 11 and holds it against the edge 91 of the housing 13. This prevents the bumper strip from separating from the housing and holds it in place on the housing 13.

Figure 20:
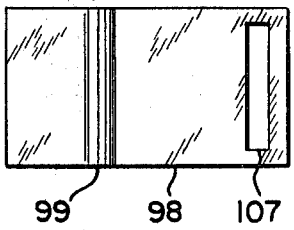
FIGS. 18–20 illustrate the preferred embodiment of the elbow latch structure of the present invention.
Figure 18:
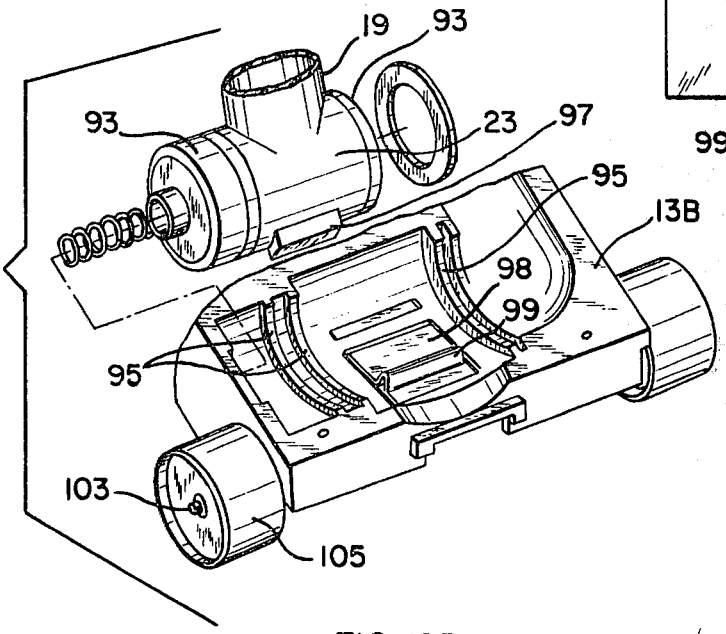

Referring to FIGS. 18–20, the vacuum cleaner coupling or elbow 23 has an extension portion 19 and a cylindrical portion 93. The cylindrical portion 93 sits in a socket 95 in the lower member 13*b* of the housing. Cylindrical portion 93 has a protrusion 97 extending therefrom and integral therewith. The protrusion 97 is formed during the molding or manufacturing of the elbow 23. Within the socket 95 is positioned a latch plate 98, which has a protrusion 99. The protrusion 99 is positioned opposite the protrusion 97 on the cylindrical portion 93. A spring 101 biases the plate 98 towards the cylindrical portion 93. The spring 101 is mounted on axle 103 of wheels 105. Plate 98 also has a slot 107 which engages a member 109 integrally formed in the housing member 13*b* so that the plate 98 can pivot about this member 109.

Figure 19A:
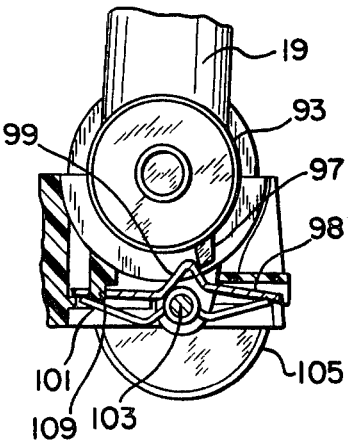
Figure 19B:
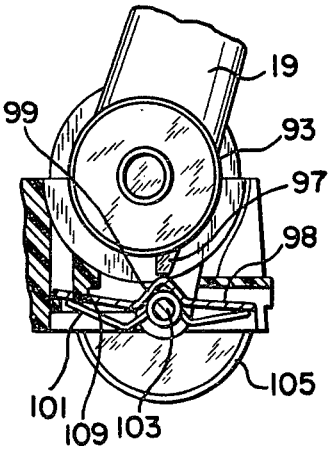

FIG. 19A illustrates the extension 19 in a substantially fixed vertical position. This position is usually used for storage when a wand is connected to the floor tool, and the floor tool and wand are stored with the wand in the vertical position. As can be seen, the protrusion 97 engages protrusion 99 and the extension 19 is held in a fixed vertical position.

Figure 19C:
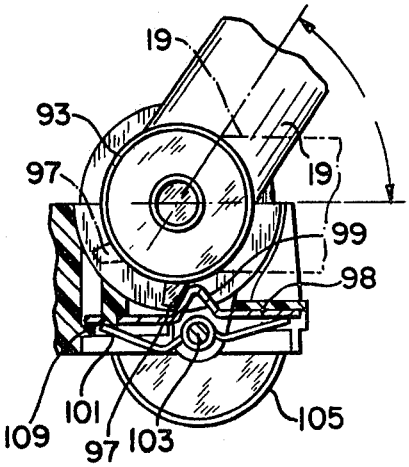

When using the floor tool, the wand is usually held in a non-vertical position. FIG. 19C illustrates the wand in its normal operating position. In this position, the protrusion 97 has been moved to the position illustrated, which allows the rotation of the cylindrical portion 93 about its axis. In going from the position illustrated in FIG. 19A to that illustrated in FIG. 19C, the latch passes through the position shown in FIG. 19B. In this position, the protrusion 97 pushes down against protrusion 99 and protrusion 99 moves downward against the force of spring 101. However, when the latch reaches the position in FIGS. 19A or 19C, the spring 101 biases the plate back up again.

The present invention may be embodied in other specific forms without departing from the spirit or essential characteristics thereof. The presently disclosed embodiments are, therefore, to be considered in all respects as being illustrative and not restrictive. The scope of this invention is intended to be indicated by the appended claims, rather than the foregoing description, and all changes which come within the meaning and range of equivalency of the claims are to be embraced therein.

What is claimed:

1. A vacuum cleaner floor tool comprising:

(a) a housing;

(b) an air-powered turbine motor in said housing;

(c) agitator means partially extending from said housing, said agitator means comprising an elongated member having at least one spiral groove therein extending in the longitudinal axial direction thereof, wherein at least one end portion of said elongated member is reduced in diameter such that said spiral groove thereon is reduced to a substantially flat surface, connector means mounted on said reduced portion, said connector means having at least one lug for engaging said substantially flat surface to prevent said elongated member from rotating relative to said connector means, and a carpet agitator fixed in said spiral groove;

(d) drive coupling means coupling said agitator means and said turbine motor such that said agitator means is driven by said turbine motor, said drive coupling means engaging said connector means;

(e) base plate means removably mounted on said housing and forming a wall thereof, said agitator means extending from said housing through an opening in said base plate means wherein air is drawn through said opening into said turbine motor; and (f) manually operable retaining means for removably holding said base plate means on said housing, said retaining means comprising a rod having one end pivotally mounted in said housing and a projection means extending from said housing for engaging the other end of said rod, wherein when said other end of said rod is engaged by said projection means, said rod contacts the outer surface of said base plate means and pushes said base plate means against said housing, whereby said retaining means retains said base plate means on said housing, and wherein when said retaining means are in a position to permit removal of said base plate means, said base plate means can be removed from said housing, thereby providing access to the interior of said turbine motor.

2. An agitator device as set forth in claim 1 wherein said carpet agitator is a brush fixed in said spiral groove.

3. A vacuum cleaner floor tool comprising:

(a) a housing;

(b) an air-powered turbine motor in said housing;

(c) agitator means partially extending from said housing, said agitator means being coupled to said turbine motor and driven thereby;

(d) base plate means removably mounted on said housing and forming a wall thereof, said agitator means extending from said housing through an opening in said base plate means, wherein air is drawn through said opening in said base plate means into said turbine motor; and (e) manually operable retaining means for removably holding said base plate means on said housing, said retaining means comprising a rod having one end pivotally mounted in said housing and a projection means extending from said housing for engaging the other end of said rod, wherein when said other end of said rod is engaged by said projection means, said rod contacts the outer surface of said base plate means and pushes said base plate means against said housing, whereby said retaining means retains said base plate means on said housing, wherein when said retaining means are in a position to permit removal of said base plate means, said base plate means can be removed from said housing, thereby providing access to the interior of said turbine motor.

4. A vacuum cleaner floor tool comprising:

(a) a housing;

(b) an air-powered turbine motor in said housing;

(c) agitator means partially extending from said housing, said agitator means being coupled to said turbine motor and driven thereby;

(d) base plate means, removably mounted on said housing and forming a wall thereof, said agitator means extending from said housing through an opening in said base plate means wherein air is drawn through said opening in said base plate means into said turbine motor;

(e) manually operable retaining means for removably holding said base plate means on said housing, said manually operable retaining means including a rod having one end pivotally mounted in said housing and a projection means extending from said housing for engaging the other end of said rod, wherein when said other end of said rod is engaged by said projection means, said rod contacts the outer surface of said base plate means and pushes said base plate against said housing, whereby said retaining means retains said base plate means on said housing; and (f) bumper strip means surrounding said housing for absorbing the impact of said floor tool against an object, said bumper strip means including lip means for contacting the exterior of said base plate means and forming an air seal therebetween.

5. A vacuum cleaner floor tool as set forth in claim 4 wherein said lip means is integral with said bumper strip means.

6. An agitator device as set forth in claim 4 wherein said carpet agitator is a brush fixed in said spiral groove.

7. A vacuum cleaner floor tool comprising:

(a) a housing;

(b) a bumper strip means surrounding said housing for absorbing the impact of said floor tool against an object, said bumper strip means including lip means for contacting the exterior of said housing and forming an air seal therebetween;

(c) an air-powered turbine motor in said housing;

(d) agitator means partially extending from said housing, said agitator means comprising an elongated member having at least one spiral groove therein extending in the longitudinal axial direction thereof, wherein at least one end portion of said elongated member is reduced in diameter such that said spiral groove thereon is reduced to a substantially flat surface, connector means mounted on said reduced portion, said connector means having at least one lug for engaging said substantially flat surface to prevent said member from rotating relative to said connector means, and a carpet agitator fixed in said spiral groove;

(e) drive coupling means coupling said agitator means and said turbine motor such that said agitator means is driven by said turbine motor, said drive coupling means engaging said connector means;

(f) base plate means removably mounted on said housing and forming a wall thereof, said agitator means extending from said housing through an opening in said base plate means, wherein air is drawn through said opening in said base plate means into said turbine motor; and (g) manually operable retaining means for removably holding said base plate means on said housing, said retaining means including a rod having one end pivotally mounted in said housing and a projection means extending from said housing for engaging the other end of said rod, wherein when said other end of said rod is engaged by said projection means, said rod contacts the outer surface of said base plate means and pushes said base plate against said housing, whereby said retaining means retains said base plate means on said housing.

* * * * *